United States Patent [19]

Lawlor

[11] 4,008,678

[45] Feb. 22, 1977

[54] SHIP MOORING SYSTEM

[75] Inventor: John Lawlor, Sewell, N.J.

[73] Assignee: Sun Shipbuilding and Dry Dock Co., Chester, Pa.

[22] Filed: Oct. 20, 1975

[21] Appl. No.: 623,703

[52] U.S. Cl. ..... 114/230

[51] Int. Cl.[2] ..... B63B 21/00

[58] Field of Search ..... 114/230, 231, .5 F; 115/235 R, 6, 9; 61/48

[56] References Cited

UNITED STATES PATENTS

| | | | |
|---|---|---|---|
| 2,938,492 | 5/1960 | Kulick | 114/230 |
| 3,088,287 | 5/1963 | Berry | 114/.5 BD |
| 3,108,563 | 10/1963 | Wurdack | 114/230 |
| 3,841,685 | 10/1974 | Kolodziej | 114/230 |

*Primary Examiner*—Trygve M. Blix

*Assistant Examiner*—Gregory W. O'Connor

*Attorney, Agent, or Firm*—J. Edward Hess; Donald R. Johnson; Paul Lipsitz

[57] ABSTRACT

A mooring system is proposed for use at docks where tide changes are large. The system requires two vertical mooring posts positioned on the dock at a distance apart so that when the ship is docked one will be at a bow section of the ship and the other at a stern section. The ship is fitted with two post-engaging devices, one in the bow area and one in the stern area, each of which will be in alignment with the appropriate mooring post. The post-engaging devices are mechanically movable so as to engage the adjacent post and the engagement will prevent horizontal movement of the ship, but will permit vertical movement in accord with the tides.

3 Claims, 8 Drawing Figures

SHIP MOORING SYSTEM

This invention deals with a mooring system for large ocean going ships and is particularly suitable for the mooring of such ships at docks where large tide changes occur; e.g., in the Bay of Fundy, Anchorage, Alaska, etc.

It is known in the art that small boats may be docked in a manner to allow rise and fall of the boat with tidal action. For example, U.S. Pat. No. 2,873,712 discloses a pair of vertically disposed guide rails, spaced to receive mooring tackle adapted to be connected to opposite end sections of a boat to be moored, the tackle having a slide member slidably mounted in each upright and urged upward by a pulling force (e.g., a spring) to exert a pulling force on the mooring line connected to the boat, but adapted to move downwardly under the weight of the boat as the tide falls, the mooring lines holding the boat against yieldable bumpers mounted on the vertical rails. While such a system is useful for small boats, the hardware needed for the pulling forces would be so massive for large ships that it would be impractical. Also, it would be very difficult to fasten a mooring line to the sliding member in the vertical rail.

The present invention provides an apparatus and method for mooring large ocean going ships in harbors where large tidal changes occur and enables such mooring to be accomplished easily and effectively. In accord with the invention a ship (1) apparatus is provided which comprises in combination: (1) a pair of vertical posts, preferably of square or rectangular cross-section spaced-apart on a dock so that when the ship is docked one post will be located opposite a bow section and the other post opposite a stern section of the ship, (2) a pair of post-engaging means on the bow and stern sections of the ship positioned to be in operable relationship with said posts when the ship is docked (i.e. the distance between the pairs of post-engaging means is equal to the distance between the posts), said post-engaging means consisting of a pair of extendable arm members mounted on the deck of said ship and which act as stops, each of said arm members which are closest the bow section of said ship having an L-shaped flange to stop movement of the ship away from the dock.

Figure 1:
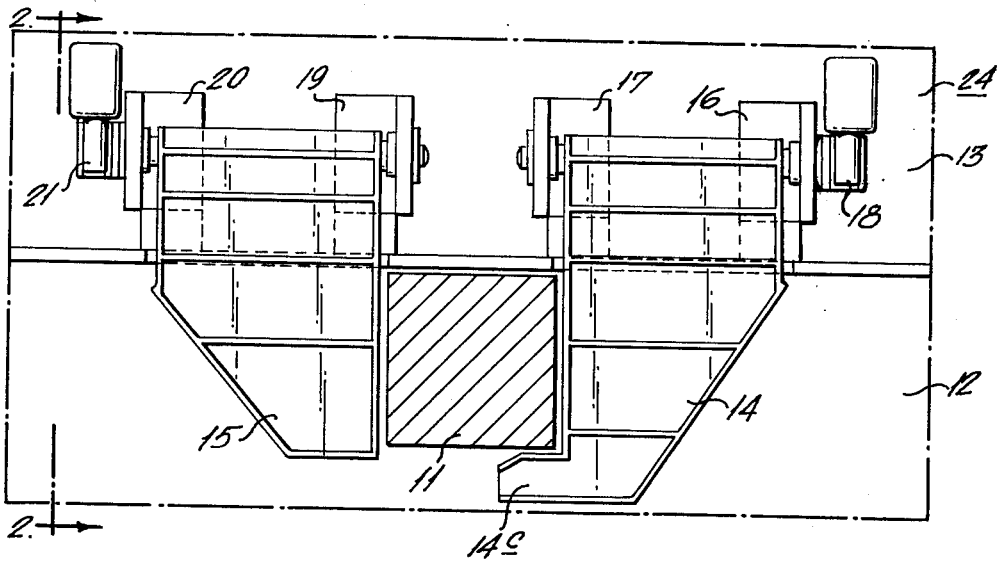
FIG. 1 is a top view of one set of arm members in engagement with a mooring post.

Referring now to FIG. 1, a post 11 is positioned vertically on a dock area 12. A bow section of a ship with deck area 13 is positioned adjacent the dock area 12. Pivotally mounted in the bow area the ship's deck is a pair of arms 14 and 15, arm 14 which is closer to the ship's bow (not shown) having an L-shaped flange section 14*c*. Arm 14 is pivotally mounted to the deck 13 by means of mounting brackets 16 and 17 and means are provided, such as a motor driven gearing system 18, to mechanically move each arm to a position vertical or horizontal to the ship's deck. Arm 15 is similarly mounted on the deck by brackets 19 and 20 and a similar motor driven gearing means 21 may be used to move this arm. As can be seen in FIG. 1, the extended arms act as stops to any horizontal movement of the moored ship, yet vertical movement to accommodate the tides is permitted. It will be understood that the post 11 could be of circular cross-section with the arm 14 being C-shaped, and arm 15 being essentially as shown, but for ease of manufacture and use, the post 11 will have preferably a square cross-section and the arms will be essentially as shown.

Figure 2:
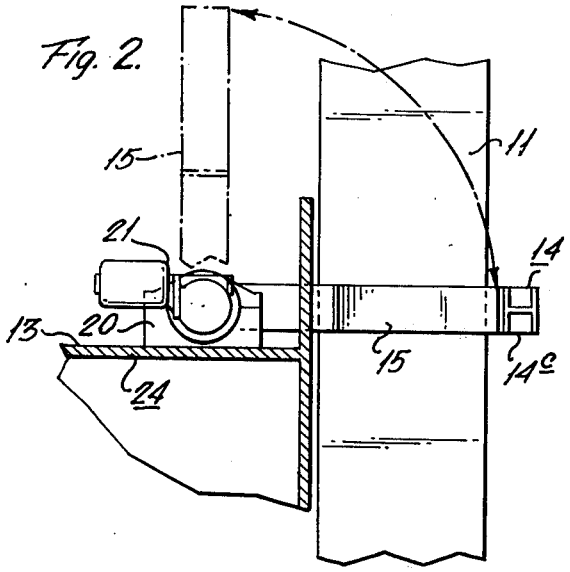
FIG. 2 illustrates the arm members in an extended operative and vertical non-operative position.

FIG. 2 is a view taken on line 2—2 of FIG. 1 and shows how the motor driven gearing means 20 mounted on the deck 13 moves arms 14 and 15 (only the L-section of arm 14 being seen) either to a horizontal, engaging position adjacent post 11 or to a vertical, non-engaging position.

Figure 3:
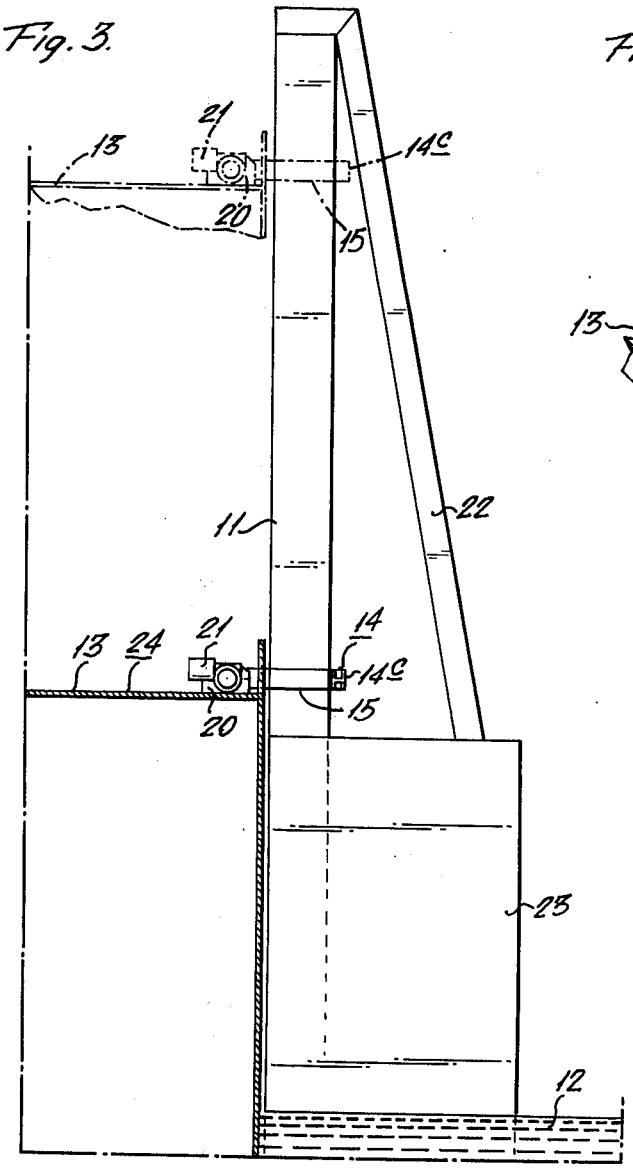
FIG. 3 illustrates the rise and fall of the ship with the tide while in a docked position.

FIG. 3 shows the mounting of post 11 with a support section 22 being mounted in a concrete form 23 for added strength and illustrates further by the dotted line sections the elevation and fall of the ship with the tide while the arms surround post 11.

Figure 4:
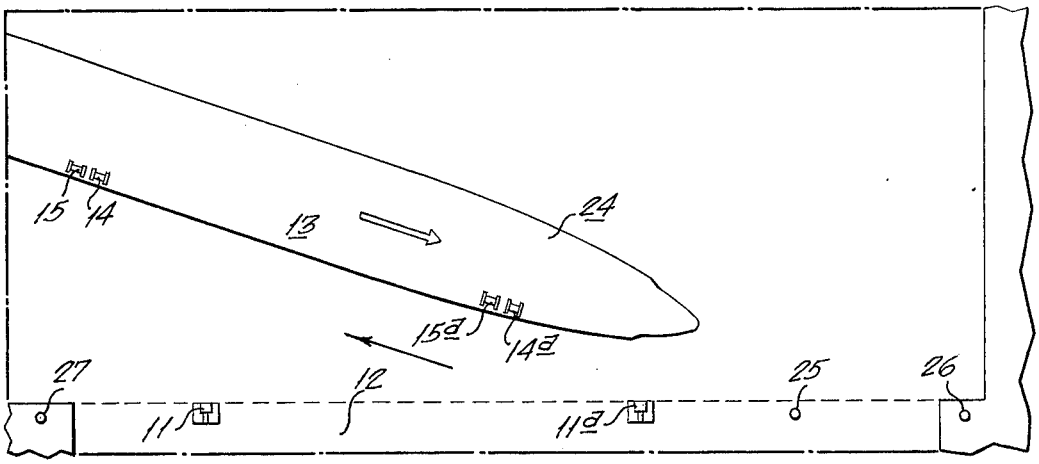
FIG. 4 and 4a to 4d show how the ship is docked to be in alignment with the mooring posts.
Figure 4A:
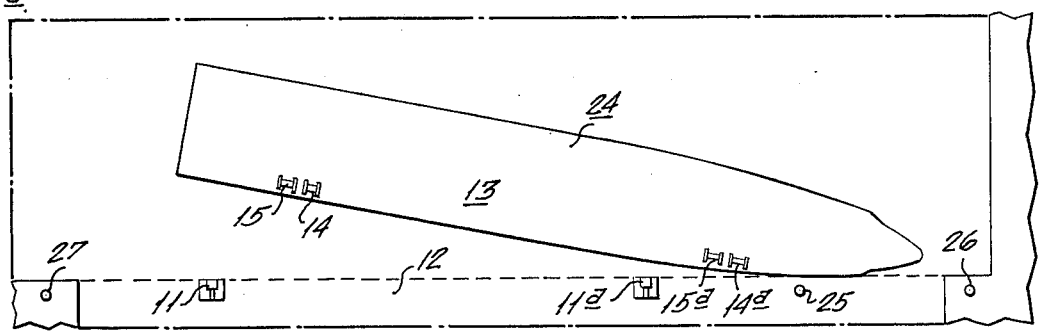
Figure 4B:
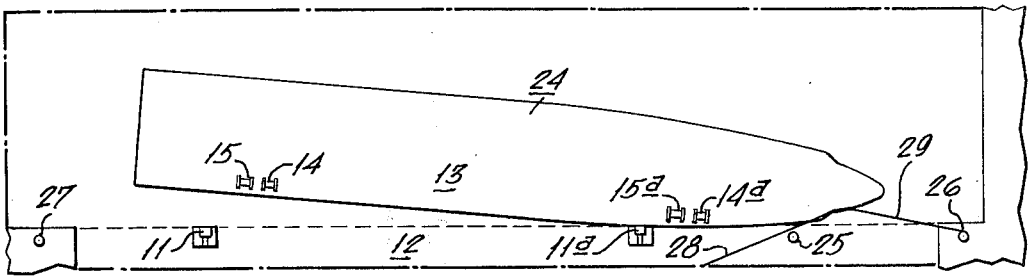
Figure 4C:
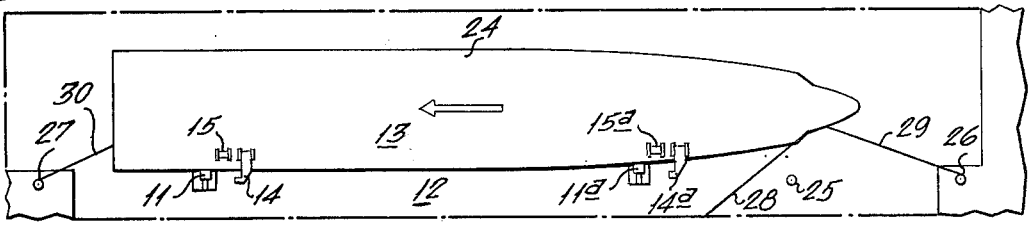
Figure 4D:
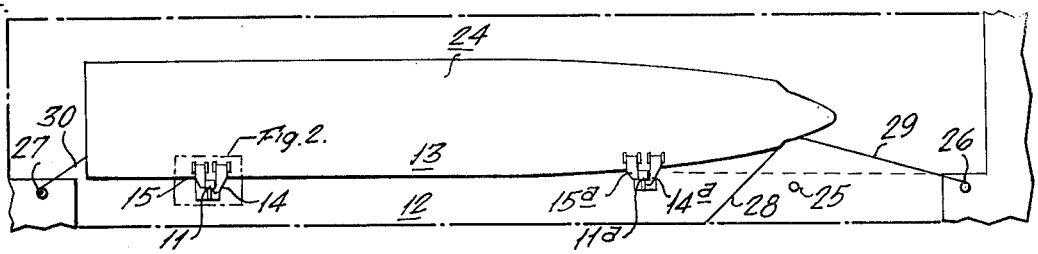

Reference is now made to FIG. 4 which illustrates how the ship is docked. As seen in FIG. 4 the ship 24 will approach the pier 12 against the tide and upstream of posts 11 and 11a so as to lay starboard side to the pier 12. As the bow comes against the pier near the pilings 25 and 26 a forward spring line 28 and bow line 29 will be put out (FIGS. 4*a* and 4*b*). Then, with the rudder hard left and the engines slow ahead the stern will swing in until the mooring posts 11 and 11*a* are just aft of the two sets of movable post-engaging arms 14 and 15 and 14*a* and 15*a*. As the stern is swinging a mooring line 30 will be put out aft of the ship to pile 27 to aid in positioning the ship (FIG. 4*c*). With the ship now alongside the pier and positioned so that the posts are just aft of the two sets of arms, the forward arm of each set of arms 14 and 14*a* are moved from a vertical position to a horizontal position outboard of the ship and the ship allowed to drift aft aided by the mooring lines if necessary until the L-shaped arms 14 and 14*a* engage the posts 11 and 11*a*. Then the remaining arms 15 and 15*a* will be swung out to effectively lock the ship in position. The ship is now unable to move from or along the pier in any horizontal direction, but will rise and fall with the tide. Fixation of the ship in this manner is particularly important for Roll-On/Roll Off ships which must maintain their positions to the loading ramps.

To release the ship from the constraints of the mooring device, the opposite procedure is, of course, followed. The arms 15 and 15*a* are moved inboard to a vertical position and the mooring lines cast off. Upon moving forward, the L-shaped arms are raised and the ship is free to maneuver as necessary to leave the port.

It will be understood, that, alternatively, the pair of arms 14 and 15 and 14*a* and 15*a* may be mounted on the hull of the ship, and preferably recessed into the hull when not in use instead of the deck, but deck mounting is preferred.

The invention claimed is:

1. A ship mooring apparatus for roll-on/roll-off ships comprising in combination:

1. a pair of vertical posts spaced apart on a dock,

2. a ship to be docked fitted with two pairs of extendable post-engaging devices, one of said pairs mounted on the bow section of said ship and the second of said pairs mounted on the stern section of said ship, said devices being spaced apart a distance equal to the distance between said posts, and means to separately extend said devices to enable engagement with said posts to prevent horizontal movement, but permit vertical movement of said ship.

2. The apparatus of claim 1 wherein the post-engaging devices are mounted on the deck of said ship.

3. The apparatus of claim 1 wherein the post-engaging devices are mounted on the hull of said ship.

* * * * *